US011683864B1

(12) United States Patent
Santagata

(10) Patent No.: US 11,683,864 B1
(45) Date of Patent: Jun. 20, 2023

(54) BRAIDED STAINLESS STEEL JACKETED FLEXIBLE HEATING CABLE

(71) Applicant: Thermal-Flex Systems, Inc., Northford, CT (US)

(72) Inventor: Daniel A. Santagata, Branford, CT (US)

(73) Assignee: Thermal-Flex Systems, Inc., Northford, CT (US)

( * ) Notice: Subject to any disclaimer, the term of this patent is extended or adjusted under 35 U.S.C. 154(b) by 0 days.

(21) Appl. No.: 17/868,334

(22) Filed: Jul. 19, 2022

(51) Int. Cl.
*H05B 3/56* (2006.01)
*E01B 7/24* (2006.01)

(52) U.S. Cl.
CPC ..... *H05B 3/56* (2013.01); *E01B 7/24* (2013.01); *H05B 2203/017* (2013.01); *H05B 2214/02* (2013.01)

(58) Field of Classification Search
CPC ... H05B 3/56; H05B 3/40; H05B 3/54; H05B 3/58; H05B 3/64; H05B 2203/017; H05B 2203/016; H05B 2203/01; H05B 2214/02; E01B 7/24
See application file for complete search history.

(56) References Cited

U.S. PATENT DOCUMENTS

| | | | | |
|---|---|---|---|---|
| 4,076,075 | A | 2/1978 | Venot | |
| 4,352,007 | A | 9/1982 | Baker et al. | |
| 4,388,523 | A | 6/1983 | Keep, Jr. et al. | |
| 4,391,425 | A | 7/1983 | Keep, Jr. | |
| 4,725,713 | A * | 2/1988 | Lehrke | G05D 23/19 374/134 |
| 5,004,190 | A | 4/1991 | Montierth et al. | |
| 5,573,687 | A | 11/1996 | Tanaka | |
| 5,824,997 | A | 10/1998 | Reichle et al. | |
| 5,941,482 | A | 8/1999 | Santagata | |
| 6,111,234 | A * | 8/2000 | Batliwalla | H05B 3/56 219/544 |
| 6,288,372 | B1 * | 9/2001 | Sandberg | H05B 3/56 219/544 |
| 10,751,507 | B2 | 8/2020 | Palmer et al. | |
| 2010/0059502 | A1 * | 3/2010 | O'Connor | H05B 3/56 219/505 |

(Continued)

FOREIGN PATENT DOCUMENTS

| | | | |
|---|---|---|---|
| CN | 2789270 | Y | 6/2006 |
| CN | 102444058 | A | 5/2012 |

(Continued)

OTHER PUBLICATIONS

Flexelec; Flextrace—Temperature Maintenance Systems; High Power Constant Power Cables; p. 57 from catalog; www.flexelec.com; downloaded from Internet Jul. 18, 2022.

(Continued)

*Primary Examiner* — Shawntina T Fuqua
(74) *Attorney, Agent, or Firm* — St Onge Steward Johnston and Reens LLC

(57) ABSTRACT

A heating cable that is usable in train track applications where railroad switches are subject to icing during cold weather, the heating cable including a coiled resistance heating wire contained in an electrical insulator, which is contained in an inner braided metal sleeve, which is contained in a flexible metal hose, which is contained in an outer braided metal sleeve.

21 Claims, 5 Drawing Sheets

(56) References Cited

U.S. PATENT DOCUMENTS

| | | | | |
|---|---|---|---|---|
| 2010/0163543 | A1 | 7/2010 | Reichle | |
| 2019/0198196 | A1* | 6/2019 | Bright | H01B 7/04 |
| 2020/0340660 | A1* | 10/2020 | Van Straten | F21V 29/87 |
| 2021/0238857 | A1* | 8/2021 | Kuhl | H05B 1/023 |

FOREIGN PATENT DOCUMENTS

| | | | |
|---|---|---|---|
| CN | 207911059 | U | 9/2018 |
| CN | 209686162 | U | 11/2019 |
| CN | 210725376 | U | 6/2020 |
| JP | H10259602 | A | 9/1998 |
| RU | 2492284 | C1 | 9/2013 |

OTHER PUBLICATIONS nVent Erico; Rail Switch Heating System; www.nVent.com/ERICO;' copyright 2018.

OmegaFlex; General Product & Engineering Design Catalog; Nov. 2019; 52 pages; www.omegaflex.com.

* cited by examiner

BRAIDED STAINLESS STEEL JACKETED FLEXIBLE HEATING CABLE

FIELD OF THE INVENTION

A heating cable assembly for use in train track applications, and more specifically a cable that includes an electrical connection at one end of the cable where the cable includes a resistance heating element that is enclosed by a braided stainless-steel sheath that forms an outermost layer of the heating cable assembly.

BACKGROUND OF THE INVENTION

Railroad switches comprise moving parts that allow a train to transition from one track to another. Typically, these switches comprise portions of track that are laterally moveable to align with one of at least two different tracks such that when a train approaches the switch, it will be directed onto the track aligned with the switch.

In cold temperatures, snow and ice can build up on and around these switches, which can inhibit the ability of the switch to move laterally and align with a track. Automatic control devices will move the switch based on a central rail control system to ensure that trains are on the correct tracks and remain on schedule. Sensors will detect the movement of the switch to ensure that they have moved to a proper location. If, however, a buildup of snow and ice prevents the movement of the switch or inhibits the movement such that the switch cannot be moved to a proper location, alarms will be sounded and the train approaching the switch will have to be stopped until the problem is fixed. Delays, however, are very costly because the trains are run on a tight schedule and a delay at one portion of the rail system can have wide ranging negative impacts across a large portion of the rail system. Additionally, the amount of energy that is lost in bringing a train to a stop and then having to start and come up to speed again is significant when considering the energy required to move a train. Safety and reliability of railroad switches is therefore a very important factor in managing a safe and efficient rail system.

The heating of a railroad rail switches to prevent failure or unreliability of the switch operation under severe weather conditions has been known for many years. However, there are a variety of problems and needs for such heating systems. These heating systems are typically positioned in or around the railroad switch and as such, are directly exposed to the harsh conditions of the railroad tracks. The extreme changes in temperature, direct exposure to harsh substances leading to corrosion, vibration caused by trains moving over the tracks, and direct damage or impact to the heating systems can cause heating systems to short circuit, ground fault and catastrophically fail.

One system that has attempted to deal with some of these issues is U.S. Pat. No. 4,388,523 (the '523 patent) that teaches use of a length of water-impervious, bendable tubing containing an electrical resistance heating wire provided on each of its ends with connectors for connecting it in an electrical circuit a source of electrical current. This system is designed to be affixed against the track such that heat from the tubing is conducted from the tubing to the rails and then to the other parts of the switch. However, a drawback of the '523 patent is that it is rigid, and not very resilient, and is therefore susceptible to physical damage, such as impact or crushing damage. Additionally, the internal construction and the subsequent positioning of the electrical leads requires lengthy wiring that is exposed to physical damage and corrosion.

Another system that has attempted to deal with the problem is U.S. Pat. No. 5,941,482 (the '482 patent), which provided a greatly improved system over the '523 patent. The '482 patent disclosed a shielding layer formed by braiding wires of a copper-nickel alloy into a sleeve fitting tightly on an insulating layer. This design does allow for the prevention of ingress of water into the structure and provides for inhibiting heat from the electrical heating element to the electrical wire connected thereto; however, this design is also susceptible to physical and vibrational damage. Additionally, the configuration of the heating element and the wiring connectors increases the amount of external electrical wiring needed to operate the system, which increases the parts that may be susceptible to physical and corrosive damage.

U.S. Pat. No. 4,391,425 (the '425 patent), is directed to a railroad switch heating system comprising lengths of a pliable insulated electrical resistance heating cable disposed against and along the outer sides of the fixed rails of the switch. Each cable length has the ends of its heating wire fitted with connectors joining it with insulated conductors in a series heating circuits. Again, this configuration is susceptible to physical damage and the configuration of the heating element, and the wiring connectors increases the amount of external electrical wiring needed to operate the system.

U.S. Pat. No. 5,004,190 (the '190 patent) is directed to a rail heating system for heating railroad components such as railroad switch areas and electrified third rails. The contact surface of the heater assembly is typically adhered to a metal sheet, which facilitates heat transfer between the heater assembly and the area to be heated. Accordingly, the '190 patent is not a heating cable, but rather uses electrical wiring to connect between heating plates.

What is desired is a heating cable that minimizes the exterior electrical wiring needed to energize the heating cable and provides for a robust heating cable that can withstand physical damage such as a crushing force and reduces stress points on the exterior of the heating cable.

What is further desired is a heating cable that allows for a large amount of flexibility to position the heating cable as needed in connection with a railroad switch even if the cable must be bent at a severe angle while not sustaining any damage or reduced efficiency.

SUMMARY OF THE INVENTION

One object of the invention is to provide a heating cable for use with a railroad switch that is highly resistant to exterior physical damage but at the same time allows for a large amount of flexibility.

It is further desired to provide a heating cable for use with a railroad switch that minimizes the amount of exterior electrical wiring providing electrical power to the heating cable.

It is still further desired to provide a heating cable for use with a railroad switch that reduces stress points on the exterior of the heating cable.

These and other objects of the present invention are achieved by provision of an electrical resistance heating cable formed as a corrugated metal hose of stainless steel or other alloys like Monel® (nickel-copper alloy with small amounts of iron, manganese, carbon, and silicon), Inconel® (nickel-chromium alloy) or Hastelloy® (nickel-molybdenum-chromium alloy), and includes a braided over-jacket for optimum protection and flexibility. In particular, the electrical resistance heating cable according to the new design is provided as a single-ended electrical connection, which functions to limit the amount of external electrical wiring extending to the heating cable.

The heating cable is very durable, extremely flexible, and allows for the minimum amount of external wiring to provide electrical power. Other heater elements currently sold in the industry are manufactured with a tube that does not have the flexibility of the current design and requires filling machines unlike the braided element. In particular, the braided stainless steel layer provides the following benefits: no stress points especially when flexing thicker wall cables, resistance to hose elongation, vibration dampening, and abrasion resistance.

In one configuration, the heating cable is provided with a resistance heating element that may be formed as a spirally extending heating element. The resistance heating element may be formed in two sections, one extending from the proximal end of the heating cable to the distal end, and the second section extending back from the distal end to the proximal end of the heating cable. The first and second sections are part of one continuous resistance heating element. Each of the first and second sections may be individually enclosed in an insulation. In turn, both of the insulated first and second sections may be enclosed by a braided layer that may comprise, for example, stainless-steel or an alloy. The stainless-steel or alloy braided layer may in turn be enclosed by an annular tube, which in turn, may be enclosed by another stainless-steel or alloy braided layer.

Other configurations may include additional layers of protective braiding (e.g., stainless steel or other alloys), which functions to increase pressure ratings of the heating cable. It should be noted that the braided material also functions as an expansion joint allowing for expansion and contraction of the heating cable due to extreme temperature variations.

As the heating cable is exposed to harsh outdoor conditions, it will be understood to those of skill in the art that suitable sealing will be used on the heating cable to ensure prevention of water ingress. This may be accomplished by a series of sealing techniques at the proximal end of the heating cable. For example, it may include providing a sealant inserted inside a heat shrink tubing that is heated and compresses the sealant into air spaces. It is contemplated that multiple heat shrink tubing may be utilized and filled with a sealant to provide thorough water resistance.

Additionally, in another configuration, a tube sleeve may be provided over top of and enclosing the various connection points for electrical power to connect to the resistance heating element. This tube sleeve may advantageously be filled with an epoxy to ensure a water tight seal.

For this application the following terms and definitions shall apply:

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one configuration, an electrical heating cable is provided having a proximal and distal end, the heating cable comprising: an tube sleeve positioned at the proximal end of the heating cable and enclosing: a first electrical conductor having a first insulation positioned within the annular tube the first electrical conductor having a first welded contact point, and a second electrical conductor having a second insulation positioned within the annular tube the second electrical conductor having a second welded contact point. The electrical heating cable further comprises a resistance heating element having a first end and a second end that couples to both the first and the second electrical conductors, the resistance heating element extending as a first section from the proximal end of the heating cable to the distal end of the heating cable and as a second section from the distal end of the heating cable to the proximal end of the heating cable, the resistance heating element formed as a continuous wire. The electrical heating cable still further comprises a third insulation enclosing the first section of the resistance heating element, a fourth insulation enclosing the second section of the resistance heating element, and a first braided layer comprising stainless steel or an alloy enclosing both the third and fourth insulations. Finally, the electrical heating cable further comprises an annular stainless-steel tube enclosing the third braided layer, and a second braided layer comprising stainless-steel or an alloy enclosing the annular stainless-steel tube. The electrical heating cable is provided such that the tube sleeve extends over and is bonded to an end of the second braided layer.

In another configuration, an electrical heating cable is provided that is formed according to the following process comprising the steps of: providing a first electrical conductor having a first insulation, providing a second electrical conductor having a second insulation, and providing a resistance heating element having a first end and a second end. The process further comprises the steps of: coupling the first electrical conductor to the first end of the resistance heating element, coupling the second electrical conductor to the second end of the resistance heating element, extending the resistance heating element as a first section from a proximal end of the heating cable to a distal end of the heating cable, and extending the resistance heating element as a second section from the distal end of the heating cable to the proximal end of the heating cable. The electrical heating cable is provided such that the resistance heating element formed as a continuous wire. The process still further comprises the steps of: enclosing the first section of the resistance heating element with a third insulation, enclosing the second section of the resistance heating element with a fourth insulation, and enclosing both the third and fourth insulations in a first braided layer comprising stainless steel or an alloy. Finally, the process further comprises the steps of: enclosing the first braided layer in an annular stainless-steel tube, enclosing the annular stainless-steel tube in a second braided layer comprising stainless-steel or an alloy, and bonding a tube sleeve to an end of the second braided layer.

The invention and its particular features and advantages will become more apparent from the following detailed description considered with reference to the accompanying drawings.

DETAILED DESCRIPTION OF THE INVENTION

Figure 1:
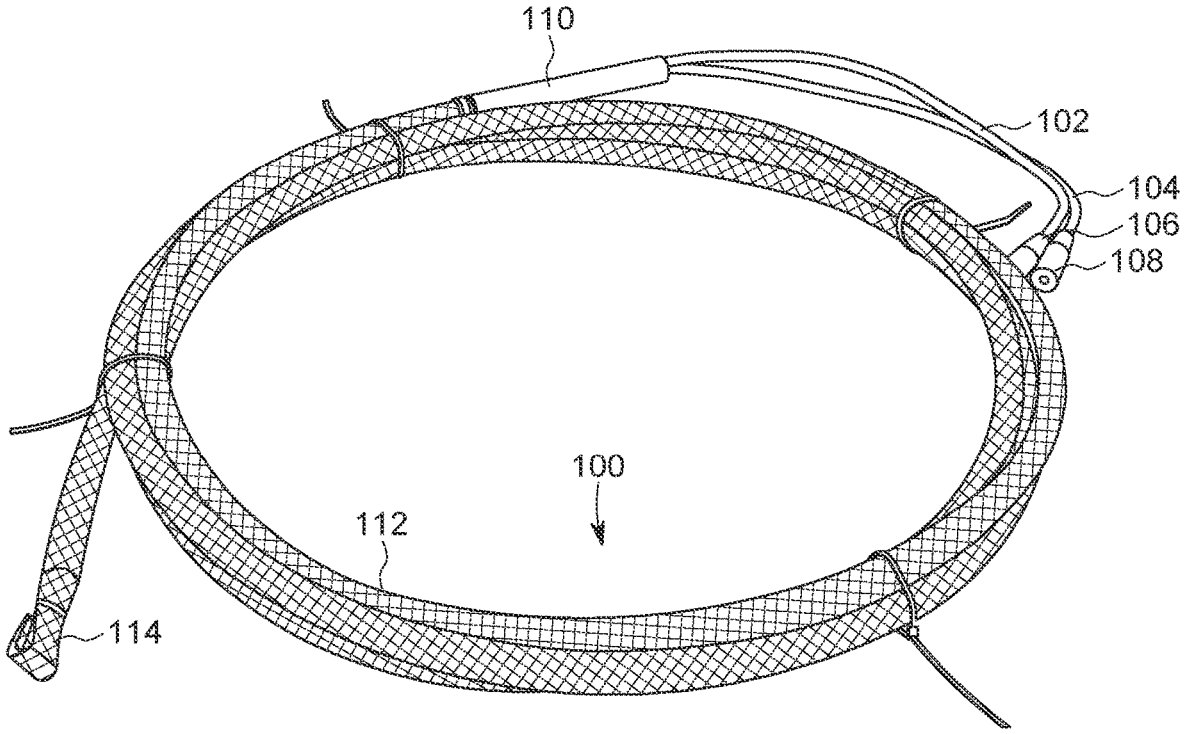
FIG. 1 illustrates a coil of a single-ended heating cable according to the invention.

Referring now to the drawings, wherein like reference numerals designate corresponding structure throughout the views.

Figure 2:
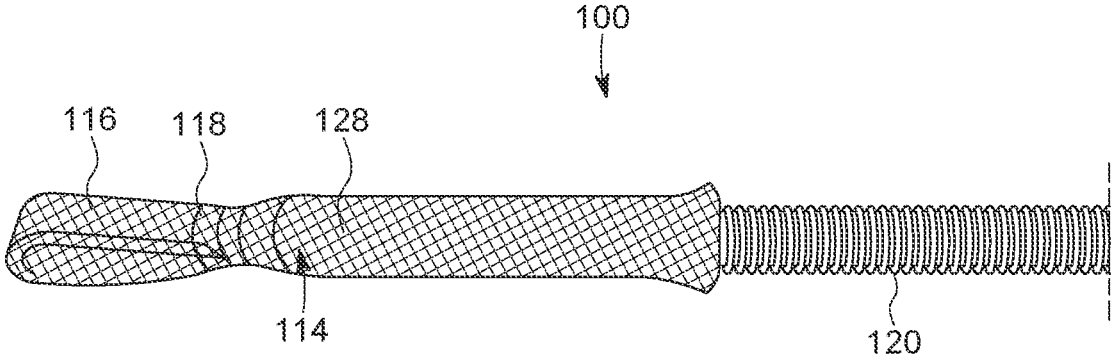
FIG. 2 is a side elevation view of the distal end of the heating cable according to FIG. 1, with a cutaway of a portion of the outer braided metal sleeve 128 to show metal hose 120

FIG. 1 shows the heating cable 100 according to one embodiment of the present invention. The heating cable 100 is provided as a single-ended heating cable with power cables 102, 104 provided at a proximal end of the heating cable 100. Power cables 102, 104 are preferably diesel locomotive power lead cables with 2000 Volt insulation in size American Wire Gauge (AWG) #8 OR AWG #6. Power cables 102, 104 each include a plug connector 106, 108 provided to connect to a power input to provide electrical power to the resistance heating element 122. The power cables 102, 104 connect to the resistance heating element 122 via a rigid tube sleeve 110. The distal end 114 of the heating cable 100 may be provided with a folded over or looped end 116 as seen in FIG. 2, in which a portion of an outer braided metal sleeve 128 has an end 118 which is welded to itself a short distance from the distal end 114 to form loop 116.

Figure 3:
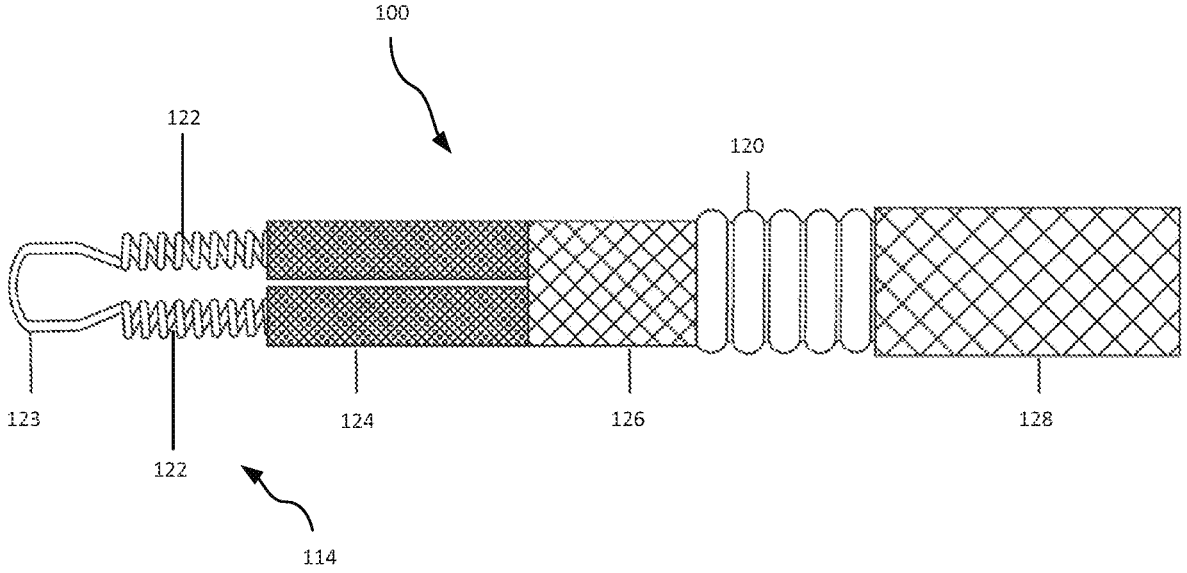
FIG. 3 is a side elevation cutaway view of the distal end of the heating cable according to FIG. 1 illustrating the layers thereof.

Referring now to FIG. 3, the construction of the heating cable 100 is shown. A resistance heating element 122 is preferably provided in the form of a coiled (spiral) resistance wire, for example, an 80%/20% nickel/chrome wire wound coli, which extends from one power cable 102 via connection 140, along the length of the heating cable 100, to the distal end 114, where the coiled wire is looped back via bend 123 to extend back along the length of the heating cable 100 to the power cable 104 via a second power connection 140. The use of a coiled resistance heating element 122 is preferred as it provides a greater heat output per unit of length relative to a straight resistance heating element of a similar diameter. However, in some applications, a straight solid or braided heating element may be used.

In preferred embodiments, resistance heating element 122 is capable of providing a minimum of 150 watts/foot, and preferably even higher, such as 200 watts/foot, up to 300 watts/foot.

Although FIG. 3 illustrates use of a single coil resistance heating element 122, it should be appreciated that two or three coil resistance heating elements may be provided, depending on the diameter of the resistance heating element 122 and the heat requirements of the particular application. Multi-coil resistance heating element applications, the coils may be formed in radially separated layers over each other or they may be positioned in series or in parallel. Furthermore, the resistance heating element 122 can be formed of a unitary piece of resistance wire or two or more resistance wire sections that are coupled together.

An electrical insulation layer 124 surrounds and encloses the resistance heating element 122. In some embodiments, the electrical insulation layer 124 comprises a ceramic and/or fiberglass braided sleeve which is fitted onto resistance heating element 122.

A inner braided metal sleeve 126 may be provided over and enclose the electrical insulation layers 124 of the two lengths of heating element 122 to protect and minimize damage to the electrical insulation layers 124. Desirably, inner braided metal sleeve shield 126 covers 60% or more of the electrical insulation layers 124 located within heating cable 100.

A flexible metal hose 120, which may be an annular corrugated metal hose or a helical corrugated metal hose or a stripwound metal hose, fits over and encloses the braided metal sleeve 126, providing resistance to crushing or other impact damage to the resistance heating element 122 of the heating cable 100.

Lastly, an outer braided metal sleeve 128 encloses the metal hose 120 and provides a final layer of shielding and protection for the heating element 122 of the heating cable 100 as well as providing for thermal growth absorption. The outer braided metal sleeve 128 has a length greater than the resistance heating element 122 such that the distal end of the outer braided metal sleeve 128 extends beyond the resistance heating element 122. The extending portion of the outer braided metal sleeve 128 is folded over and the end 118 of the outer braided metal sleeve 128 is welded to the outer braided metal sleeve 128 to form a loop 116 at the distal end 114 of heating cable 100. Loop 116 can be used to pull heating cable 100 during layout or for installation on a train track.

Together, the metal hose 120 and outer metal sleeve 128 are referred to as jacket 112. In preferred embodiments, the jacket 112 has either a nominal hose size of ¼ inch with a nominal outside diameter of 0.51 inch, or a nominal hose size of ⅜ inch with a nominal outside diameter of 0.67 inch. Other hose sizes may be used depending on the application, but in general the above sizes provide both sufficient heating and flexibility of storage, installation, and use.

The metal hose 120 and outer metal sleeve 128 of jacket 112 may comprise stainless steel or other alloys like Monel®, Inconel® or Hastelloy®.

Many different configurations can be used in the selection and arrangement of the layers of the electrical cable without deviating from the concept of the invention.

Figure 4:
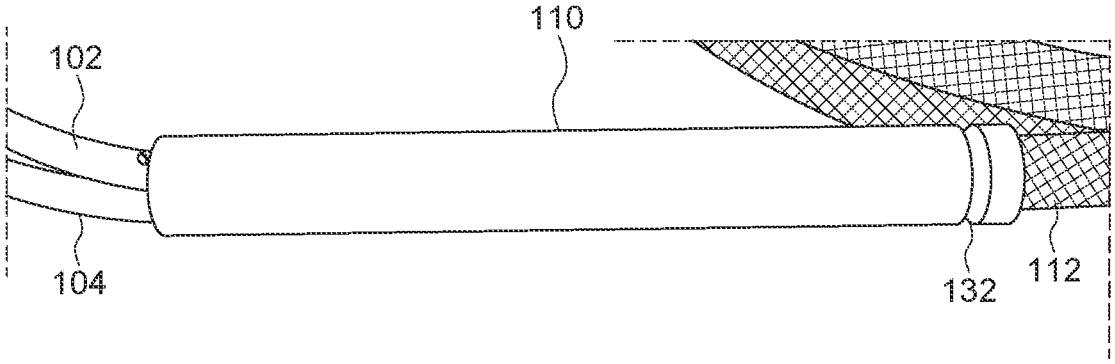
FIG. 4 is a side elevation view of a portion of the proximal end of the heating cable according to FIG. 1.
Figure 5:
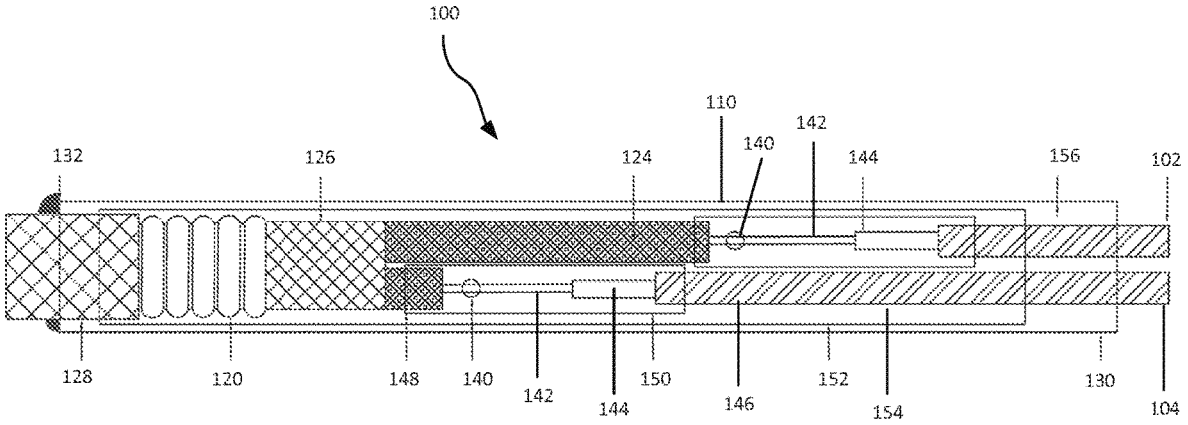
FIG. 5 is a side elevation view of the proximal end of the heating cable according to FIG. 1.

Referring now to FIGS. 4 and 5, FIG. 4 shows a view of the tube sleeve 110 that receives the power connections 102, 104 is shown. The tube sleeve 110 may be formed of copper or stainless steel, and is coupled to the outer braided metal sleeve 128 via a crimp joint and/or solder joint 132.

FIG. 5 provides a side view of the single-ended power connection configuration illustrating the internal configuration of the connections for heating cable 100 within tube sleeve 110. Tube sleeve 110 receives power cables 102, 104. Power cables 102, 104 are insulated with a rubberized electrical insulator 146. A suitable epoxy 156 may fill the open end 130 of tube sleeve 110.

Heating element 122 is provided with a welded or soldered connection 140 to a nickel cold lead 142 that is connected to the butt crimp 144 of power cables 102, 104.

Heating element 122 is enclosed in electrical insulation 124 which is in turn enclosed in inner braided metal sleeve 126.

Inner braided metal sleeve 126 is contained within flexible metal hose 120 (which may be an annular corrugated metal hose or a helical corrugated metal hose or a stripwound metal hose as prior described); similarly, outer braided metal sleeve 128 encloses the metal hose 120 as prior described. The flexible metal hose 120 may be plugged and silver soldered for environment tightness.

A first heat shrink tubing 148 may be provided around the electrical insulation 124 and the connectors 140, 142, 144 and the power cables 102, 104. Within the heat shrink tubing 148, a sealant 150 may be provided that, when the heat shrink tubing 148 is heated and shrinks, will force the sealant 150 into any air pockets surrounding the crimp connectors DLO cable and cold leads. A second heat shrink tubing 152 with sealant 154 is positioned over all the connectors and metal hose 120 and outer braided metal sleeve 128 as depicted in FIG. 5.

The resistance heating element 122 receiving electrical power allows the heating cable 100 to having minimal electrical wiring powering the heating cable 100.

Desirably, all of the various components are sealed to each other by soldering or epoxy to provide a watertight construction.

It should be noted that, while various structures, functions and methods have been described and presented in a sequence of steps or order combinations, the structure has been provided merely as an illustration of one advantageous embodiment, and that it is not necessary to supply these in the specific order illustrated. It is further contemplated that any of these structures and/or steps may be moved and/or combined relative to any of the other steps. In addition, it is still further contemplated that it may be advantageous, depending upon the application, to utilize all or any portion of the structures or functions described herein.

Accordingly, while the invention has been described with reference to a particular arrangement of parts, features and the like, these are not intended to exhaust all possible arrangements or features, and indeed many other modifications and variations will be ascertainable to those of skill in the art.

What is claimed is:

1. An electrical heating cable having a proximal and distal end, said heating cable comprising:

a tube sleeve positioned at said proximal end of said heating cable and enclosing:

a first electrical conductor having a first electrical insulation positioned within said annular tube said first electrical conductor having a first contact point;

a second electrical conductor having a second electrical insulation positioned within said annular tube said second electrical conductor having a second contact point;

a resistance heating element having a first end and a second end that couples to both the first and the second electrical conductors, said resistance heating element extending as a first section from the proximal end of the heating cable to the distal end of the heating cable and as a second section from the distal end of the heating cable to the proximal end of the heating cable;

a third electrical insulation enclosing said first section of said resistance heating element;

a fourth electrical insulation enclosing said second section of said resistance heating element;

a first braided metal sleeve enclosing both said third and fourth insulations;

a flexible metal hose enclosing said first braided metal sleeve; and a second braided metal sleeve enclosing said metal hose;

said tube sleeve receiving and being bonded to an end of said second braided metal sleeve.

2. The electrical heating cable according to claim 1, wherein said resistance heating element is a coiled wire.

3. The electrical heating cable according to claim 1, wherein said third and fourth insulation each comprise a braided ceramic and fiberglass sleeve.

4. The electrical heating cable according to claim 1, further comprising:

a first heat shrink tube enclosing a first connection location where said first electrical conductor is coupled to the first end of said resistance heating element;

said first heat shrink tube extending over an end of said first insulation and said third insulation;

said first heat shrink tube filled with a sealant and shrunk to ensure the sealant fills all air spaces in and around said first connection.

5. The electrical heating cable according to claim 4, further comprising:

a second heat shrink tube enclosing a second connection location where said second electrical conductor is coupled to the second end of said resistance heating element;

said second heat shrink tube extending over an end of said second insulation and said fourth insulation;

said second heat shrink tube filled with a sealant and shrunk to ensure the sealant fills all air spaces in and around said second connection.

6. The electrical heating cable according to claim 5, further comprising:

a third heat shrink tube enclosing both said first and second heat shrink tubes;

said third heat shrink tube extending over an end of said third and fourth insulations, and an end of said first braided metal sleeve, and an end of said annular stainless-steel tube, and an end of said second braided metal sleeve.

7. The electrical heating cable according to claim 6, wherein said third heat shrink tube of filled with an epoxy and shrunk to ensure the epoxy fills all air spaces in and around said first and second heat shrink tubes, the ends of said third and fourth insulations, the end of said first braided metal sleeve, the end of said annular stainless-steel tube, and the end of said second braided metal sleeve.

8. The electrical heating cable according to claim 7, wherein said tube sleeve fully encloses said third heat shrink tube.

9. The electrical heating cable according to claim 1, wherein said tube sleeve comprises copper or stainless steel.

10. The electrical heating cable according to claim 1, wherein said tube sleeve is bonded to said second braided metal sleeve via a crimp connection, a weld, or combinations thereof.

11. The electrical heating cable according to claim 1, wherein the flexible metal hose comprises an annular corrugated metal hose or a helical corrugated metal hose or a stripwound metal hose.

12. The electrical heating cable according to claim 1, wherein one or both of the inner braided metal sleeve and outer braided metal sleeve comprise stainless steel.

13. The electrical heating cable according to claim 1, wherein one or both of the inner braided metal sleeve and outer braided metal sleeve comprise an alloy selected from the group consisting of: nickel-copper alloy, nickel-chromium alloy, and nickel-molybdenum-chromium alloy, and combinations thereof.

14. An electrical heating cable formed according to the process comprising the steps of:

providing a first electrical conductor having a first insulation;

providing a second electrical conductor having a second insulation;

providing a resistance heating element having a first end and a second end;

coupling said first electrical conductor to said first end of said resistance heating element;

coupling said second electrical conductor to said second end of said resistance heating element;

extending said resistance heating element as a first section from a proximal end of the heating cable to a distal end of the heating cable;

extending said resistance heating element as a second section from the distal end of the heating cable to the proximal end of the heating cable;

said resistance heating element formed as a continuous wire;

enclosing said first section of said resistance heating element with a third insulation;

enclosing said second section of said resistance heating element with a fourth insulation;

enclosing both said third and fourth insulations in an inner metal braided sleeve;

enclosing said inner metal braided sleeve in a flexible metal hose;

enclosing said flexible metal hose in an outer metal braided sleeve; and bonding a tube sleeve to an end of said outer metal braided sleeve.

15. The electrical heating cable formed according to claim 14, further comprising the step of forming said resistance heating element as a spirally extending heating wire.

16. The electrical heating cable formed according to claim 14, further comprising the steps of:

enclosing a first connection location where said first electrical conductor is coupled to the first end of said resistance heating element with a first heat shrink tube, where said heat shrink tube extends over an end of said first insulation and said third insulation;

filling said first heat shrink tube with a sealant; and shrinking said first heat shrink tube such that the sealant fills all air spaces in and around said first connection;

enclosing a second connection location where said second electrical conductor is coupled to the second end of said resistance heating element with a second heat shrink tube, where said second heat shrink tube extends over an end of said second insulation and said fourth insulation;

filling said second heat shrink tube with a sealant; and shrinking said second heat shrink tube such that the sealant fills all air spaces in and around said second connection;

enclosing both said first and second heat shrink tubes with a third heat shrink tube;

said third heat shrink tube extending over said third and fourth insulations, said first braided metal sleeve, said annular stainless-steel tube, and said second braided metal sleeve.

17. An electrical heating cable having a proximal end and a distal end with a length therebetween, said heating cable comprising:

one or more resistance heating wires extending from a first power connection at the proximal end of the heating cable along the length of the heating cable to the distal end of the heating cable and back from the distal end of the heating cable to a second power connection at the proximal end of the heating cable;

an electrical insulation containing the one or more resistance heating wires and the one or more resistance heating wires;

an inner braided metal sleeve containing the electrical insulation and the one or more resistance heating wires;

a flexible metal hose containing the inner braided metal sleeve and the electrical insulation and the one or more resistance heating wires;

an outer braided metal sleeve containing the metal hose and the inner braided metal sleeve and the electrical insulation and the one or more resistance heating wires;

a tube sleeve positioned near the proximal end of the heating cable and enclosing the first power connection and the second power connection;

a first power cable electrically and mechanically connected to the first power connection;

a second power cable electrically and mechanically connected to the second power connection;

wherein the outer braided metal sleeve has a length greater than the one or more resistance heating wires, with a distal end thereof extending beyond the resistance heating wires and folded over and welded to the outer braided metal sleeve to form a loop at the distal end of the heating cable.

18. The electrical heating cable of claim 17, wherein the one or more resistance heating wires are coiled wires.

19. The electrical heating cable of claim 17, wherein the flexible metal hose is an annular corrugated metal hose or a helical corrugated metal hose or a stripwound metal hose.

20. The electrical heating cable of claim 1, wherein the second braided metal sleeve has a length greater than the resistance heating element, with a distal end thereof extending beyond the resistance heating element and folded over and welded to the second braided metal sleeve to form a loop at the distal end of the heating cable.

21. The electrical heating cable formed according to claim 14, wherein the outer braided metal sleeve has a length greater than the resistance heating elements, with a distal end thereof extending beyond the resistance heating elements and folded over and welded to the outer braided metal sleeve to form a loop at the distal end of the heating cable.

* * * * *